US008342343B2

(12) United States Patent
Shea

(10) Patent No.: US 8,342,343 B2
(45) Date of Patent: Jan. 1, 2013

(54) FREE-STANDING, POINT-OF-PURCHASE DISPLAY

(75) Inventor: Thomas M. Shea, Troy, MI (US)

(73) Assignee: T. M. Shea Products, Inc., Troy, MI (US)

( * ) Notice: Subject to any disclaimer, the term of this patent is extended or adjusted under 35 U.S.C. 154(b) by 14 days.

(21) Appl. No.: 11/961,525

(22) Filed: Dec. 20, 2007

(65) Prior Publication Data

US 2008/0156749 A1 Jul. 3, 2008

Related U.S. Application Data

(60) Provisional application No. 60/871,011, filed on Dec. 20, 2006, provisional application No. 60/910,840, filed on Apr. 10, 2007.

(51) Int. Cl.

| | |
|---|---|
| ***A47F 5/02*** | (2006.01) |
| ***A47F 5/08*** | (2006.01) |
| ***A47F 3/10*** | (2006.01) |
| ***A47B 47/03*** | (2006.01) |
| ***A47B 57/08*** | (2006.01) |

(52) U.S. Cl. ..... 211/163; 211/57.1; 211/189; 312/135

(58) Field of Classification Search ..... 211/7, 53, 211/56, 57.1, 58, 59.1, 78, 85.1, 113, 131.1, 211/163, 186, 187, 189, 190, 195, 205; 108/28, 108/107, 108, 110, 147.11, 147.17, 157.13; 312/125, 135, 305; D6/457, 465; 280/47.35, 280/79.11, 79.3; 40/124.07, 657

See application file for complete search history.

(56) References Cited

U.S. PATENT DOCUMENTS

| | | | | | |
|---|---|---|---|---|---|
| 1,630,469 | A | * | 5/1927 | Cecil | 312/125 |
| 2,740,684 | A | * | 4/1956 | Haralson | 312/319.5 |
| 3,243,047 | A | * | 3/1966 | Witteborg | 211/41.1 |
| 3,855,943 | A | * | 12/1974 | Larson | 108/28 |
| 3,957,159 | A | * | 5/1976 | Radek | 211/4 |
| 3,981,405 | A | * | 9/1976 | Slack | 211/70 |
| 4,003,470 | A | * | 1/1977 | Lagorio et al. | 211/50 |
| 4,157,760 | A | * | 6/1979 | Wilson | 211/85.1 |
| 4,269,124 | A | * | 5/1981 | Rosenthal et al. | 108/103 |
| 4,673,090 | A | * | 6/1987 | Crosslen | 211/183 |
| 4,951,827 | A | * | 8/1990 | Moransais | 211/59.1 |
| 5,360,134 | A | * | 11/1994 | Falk et al. | 221/2 |
| 5,628,413 | A | * | 5/1997 | Lu et al. | 211/13.1 |
| D401,083 | S | * | 11/1998 | Woodward | D6/461 |
| D445,273 | S | * | 7/2001 | Brown et al. | D6/396 |
| 6,405,880 | B1 | * | 6/2002 | Webb | 211/59.2 |
| 6,729,484 | B2 | * | 5/2004 | Sparkowski | 211/187 |
| 6,942,112 | B2 | * | 9/2005 | Robbins, III | 211/113 |
| 2005/0284825 | A1 | * | 12/2005 | Goldsmith et al. | 211/4 |

* cited by examiner

*Primary Examiner* — Darnell Jayne
*Assistant Examiner* — Joshua Rodden
(74) *Attorney, Agent, or Firm* — Harness, Dickey & Pierce, P.L.C.

(57) ABSTRACT

A free-standing, point-of-purchase display includes a base portion and a display portion. The display portion upwardly extends from the base portion and includes a frame having a plurality of upright members and at least one display element for supporting product for retail display. The display further includes first and second advertising panels carried by first and second upright members of the plurality of uprights, respectively.

15 Claims, 11 Drawing Sheets

FREE-STANDING, POINT-OF-PURCHASE DISPLAY

CROSS-REFERENCE TO RELATED APPLICATIONS

This application claims priority to U.S. Provisional Patent Application No. 60/871,011 filed 20 Dec. 2006 and U.S. Provisional Application No. 60/910,840 filed 10 Apr. 2007, which applications are herein expressly incorporated by reference.

FIELD

The present teachings generally relate to free-standing, point-of-purchase displays.

BACKGROUND

A multitude of product and product categories crowd the aisles and merchandise displays of retail stores. Free-standing, point-of-purchase displays can be used to showcase products or product categories, attract attention and otherwise increase sales within a retail store. Additionally, with fluctuating market demands, seasonal space requirements and influx of new products, there is a constant need to provide additional areas for product that easily attains optimal visibility.

Although existing point-of-purchase displays can be satisfactory for their intended purposes, there remains a need in the pertinent art for improvement.

DRAWINGS

The present invention will become more fully understood from the detailed description and the accompanying drawings, wherein.

SUMMARY

Figure 1:
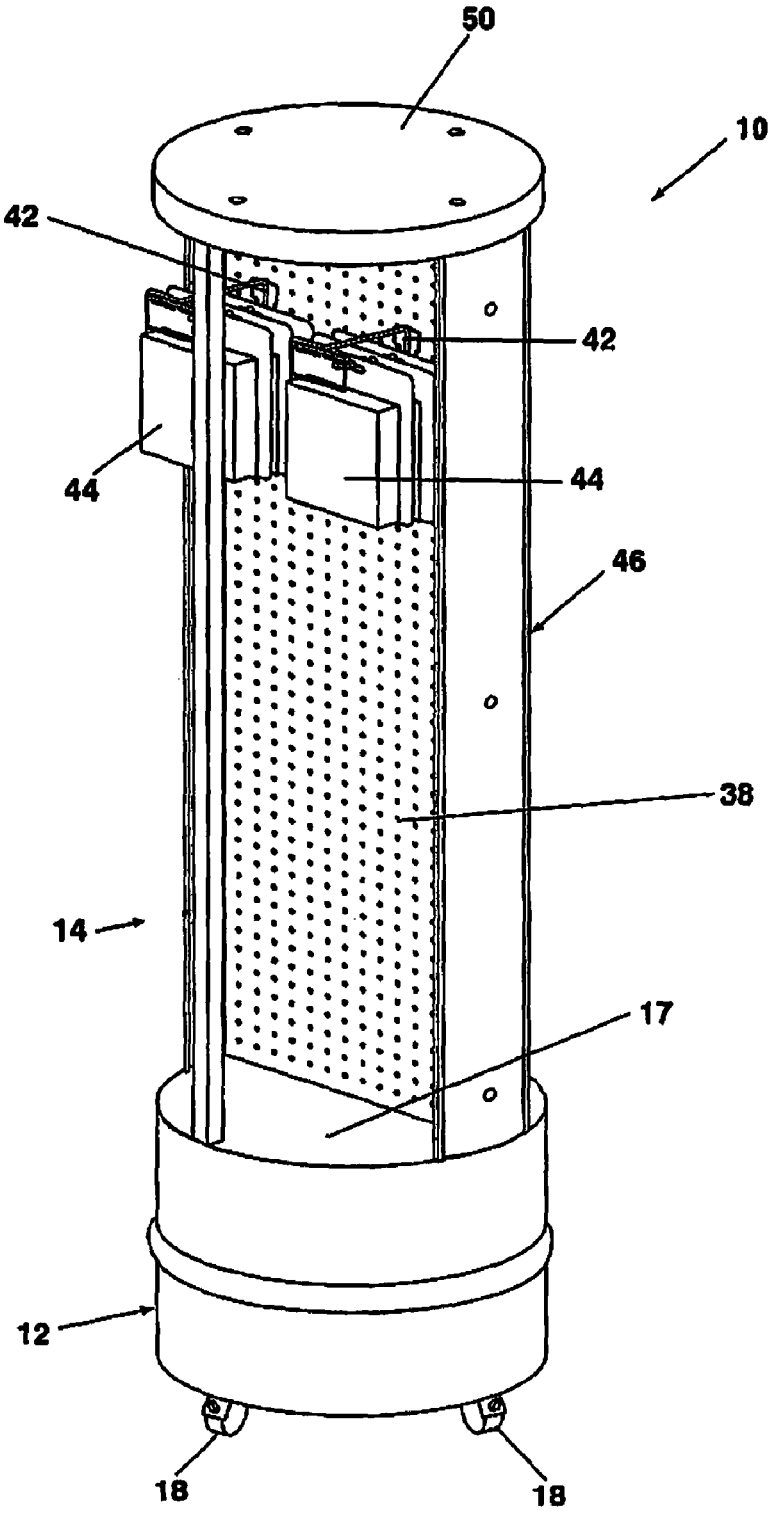
FIG. 1 is a perspective view of a point-of purchase display system according to the present teachings.

According to one particular aspect, the present teachings provide a free-standing, point-of-purchase display. The display includes a base portion and a display portion. The display portion upwardly extends from the base portion and includes a frame having a plurality of upright members and at least one display element for supporting product for retail display. The display further includes first and second advertising panels carried by first and second upright members of the plurality of uprights, respectively.

Further areas of applicability will become apparent from the description provided herein. It should be understood that the description and specific examples are intended for purposes of illustration only and are not intended to limit the scope of the present disclosure.

DESCRIPTION OF VARIOUS ASPECTS

The following description is merely exemplary in nature and is in no way intended to limit the invention, its application, or uses.

With reference to FIGS. 1 through 4, a point-of-purchase display system according to the present teachings is illustrated and generally identified at reference character 10. The display system 10 is illustrated to generally include a base portion 12 and a display portion 14. The base portion 12 is illustrated as a free-standing structure and the display portion 14 upwardly extends from the base portion 12.

The base portion 12 may be generally cylindrical in shape. As shown most particularly in the cut-away view of FIG. 4, the base may define a storage area 16. The storage area 16 may be used, for example, to store product for re-stocking of the display system 10. The storage area 16 may be covered by a cover 17. While the base portion 12 is illustrated as being cylindrical, it will be understood that the base portion 12 may alternatively be square or of any other shape within the scope of the present teachings.

The display assembly 10 may be portable and thereby easily moved from location to location within a retail store. To facilitate the portable nature of the display assembly 10, the base portion 12 may be provided with a plurality of wheels or casters 18. The casters 18 may be mounted in a conventional manner to a lower plate 20 (see FIG. 4). In certain applications, it may be desirable that the casters 18 are lockable casters so as to prevent unintended movement of the display assembly 10. In other applications, the display assembly 10 may be stationary.

In certain applications, the lower plate 20 may rotate relative to the remainder of the display assembly 10. In this regard, the remainder of the display assembly 10 can be articulated in a lazy-Suzanne type manner without moving the casters 18 which may be locked. The mechanism for providing this relative movement may be any known mechanism in the art.

Figure 4:
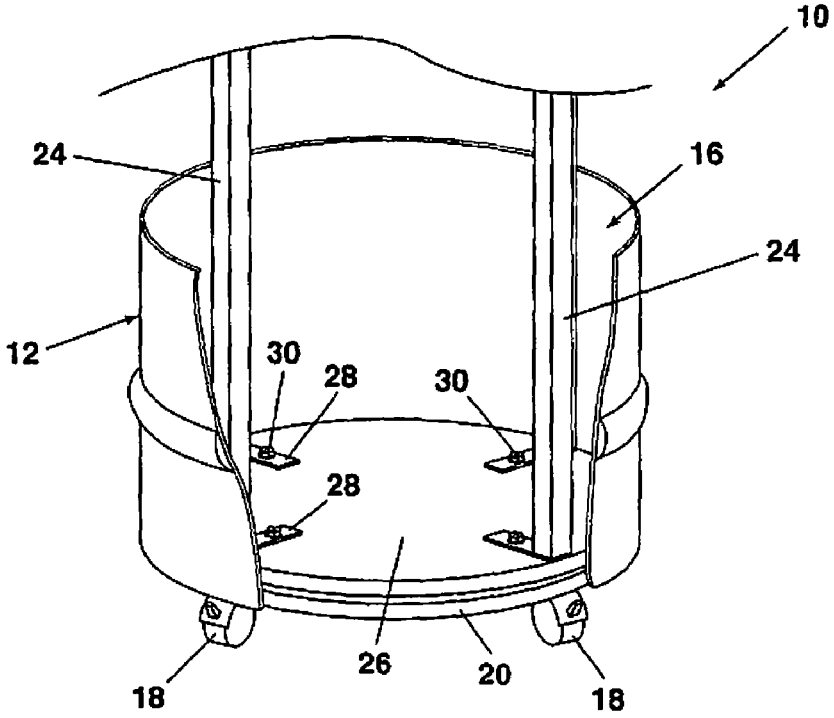
FIG. 4 is an enlarged perspective view of a portion of the point-of-purchase display system of FIG. 1 shown partially cut-away.

The display assembly 10 includes a frame 22 having a plurality of upright members 24. The plurality of upright members may include four upright members 24. As shown in FIG. 4, lower ends of the upright members 24 may be secured to a lower portion 26 of the base portion 12 with suitable brackets 28. The brackets 28 may be secured to the lower portion 26 of the base portion 12 with screws 30 or in any other manner well known in the art. The upright members 24 may be equally spaced from one another about an imaginary circle.

Figure 2:
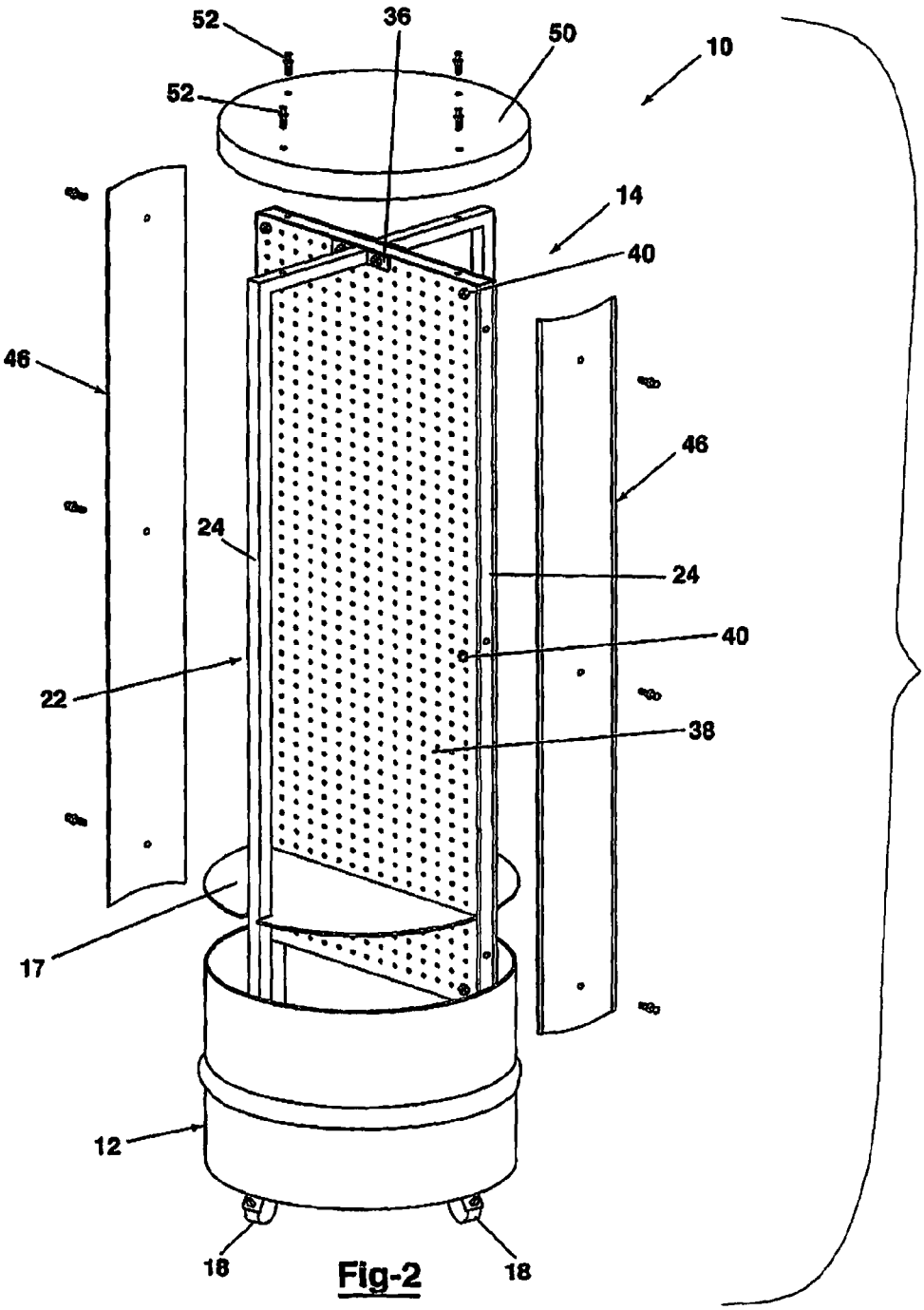
FIG. 2 is a partially exploded perspective view of the point-of-purchase display system of FIG. 1.
Figure 3:
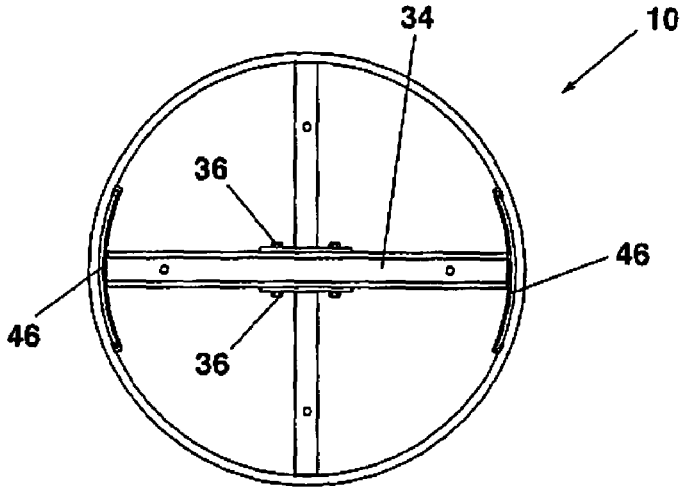
FIG. 3 is a top view of the point-of-purchase display system of FIG. 1, illustrated with a top removed for purposes of illustration.

As shown in FIGS. 2 and 3, the upright members 24 may be fixed or secured to one another proximate an upper end or top of the display assembly 10 to provide further structure to the assembly 10. Two of the opposing upright members 24 may connect by an integral or discrete cross-member 34. The other two upright members 24 may be independently secured to the cross-member 34 with a suitable bracket 36 or any other manner known in the art. Other known manners include but are not limited to welding.

The display portion 14 may additionally include at least one display element for supporting product for retail display. As illustrated, the display element may include one or more display panels 38. The one or more display panels may include two display panels 38 oriented substantially parallel to one another. The display panels 38 may be peg boards including a plurality of holes arranged in rows and columns. The display panels 38 may be secured to an opposing pair of the upright members 24 with screws 40 or in any manner well known in the art. Mounting members 42 may be conventionally coupled anywhere on the display panels 38 for the suspension of retail product 44.

The display portion 14 may additionally include one or more advertising panels 46. The one or more advertising panels may include a pair of advertising panels 46. The advertising panels 46 may be constructed of a plastic or other suitable material and may define a channel for slidably receiving card stock or similar material pre-printed with graphics (not specifically shown). The advertising panels 46 may be curved within a horizontal plane so as to aesthetically compliment the generally cylindrical shape of the display assembly 10. The advertising panels 46 may extend substantially along the height of the respective upright members.

The base portion 12 having an outer surface having a base curvature in a generally horizontal plane extending through the base portion 12, and the first and second advertising panels 46 have an advertising panel curvature in a generally horizontal plane extending through the advertising panels 46, wherein the base curvature is substantially the same as the advertising panel curvature as seen FIG. 3.

The display assembly 10 may additionally include a top 50. The top 50 may be secured to the frame 22 with fasteners 52 or in any manner well known in the art. In this regard, the fasteners 52 may pass through apertures in the top 50 and threadably engage the frame 22. The top 50 may be disc shaped. An advertising card may be secured to the top 50. Alternatively, buckets or dump-in tubs for holding product may be placed on the top 50.

Figure 5:
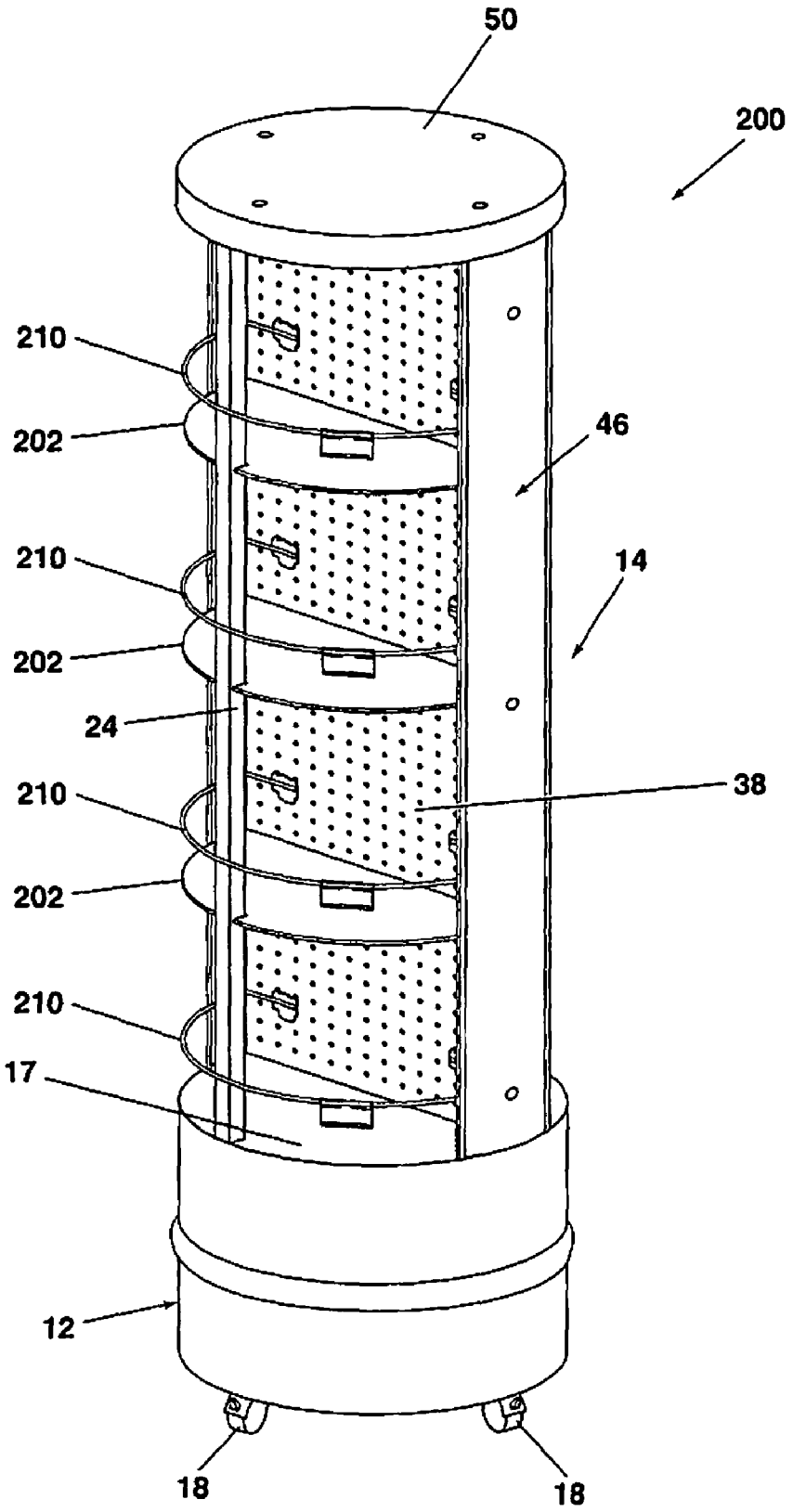
FIG. 5 is a perspective view of another point-of purchase display system according to the present teachings.
Figure 6:
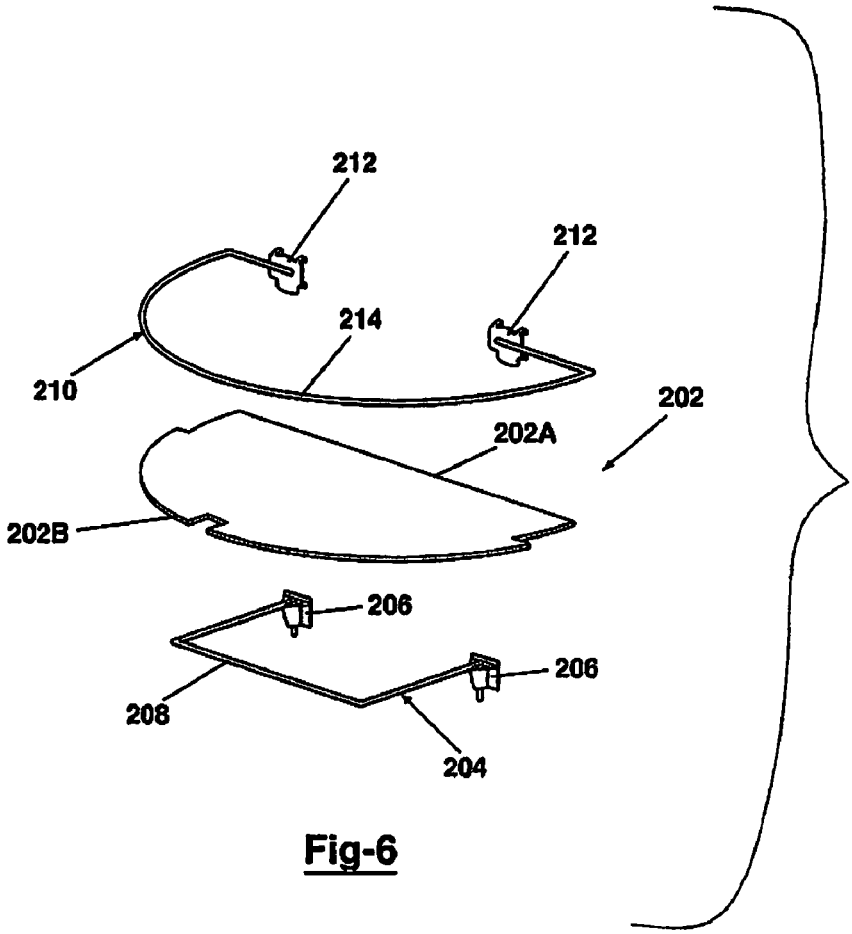
FIG. 6 is an enlarged and exploded, perspective view of one of the shelves and associated brackets of the point-of-purchase display system of FIG. 5.
Figure 7:
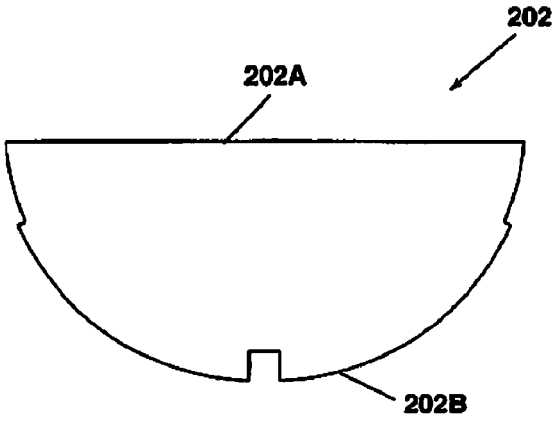
FIG. 7 is a top view of the shelf of FIG. 6.

With reference to FIGS. 5 through 7, another point-of-purchase display system according to the present teachings is illustrated and generally identified at reference character 200. The display system 200 shares various features in common with the display system 10 described. For this reason, like reference characters have been used to identify substantially similar elements throughout the various drawings.

The display system 200 may include a plurality of shelves 202. The plurality of shelves may include three shelves 202. Alternatively, the plurality of shelves 202 may include a greater or lesser number of shelves. The shelves may be cut-away to accommodate the advertising panels 46 and one of the upright members 24. A first side 202A may be generally linear to abut one of the display panels 38. An opposite side 202B may be generally arcuate to again aesthetically complement the cylindrical shape of the display assembly 10.

With reference to FIG. 6, the shelves 202 may be suspended from the display panel 38 with mounting brackets 204. The mounting brackets 204 may include mounting portions 206 for conventionally engaging the display panel 38. The mounting brackets 204 may additionally include a support arm 208 extending between the mounting portions 206.

Each of the shelves 202 may be associated with a shelf bracket 210. The shelf brackets 210 may retain product positioned on a respective shelf 202. The shelf brackets 210 may include mounting portions 212 for conventionally engaging the display panel 38. The shelf brackets 212 may additionally include a retention arm 214 extending between the mounting portions 212. The retention arm 214 may be generally arcuate in shape and adapted to be disposed above a perimeter of an associated shelf 202. An additional shelf bracket 212 may be used proximate to the cover 17 for retaining product positioned on a top of the cover 17.

Figure 8:
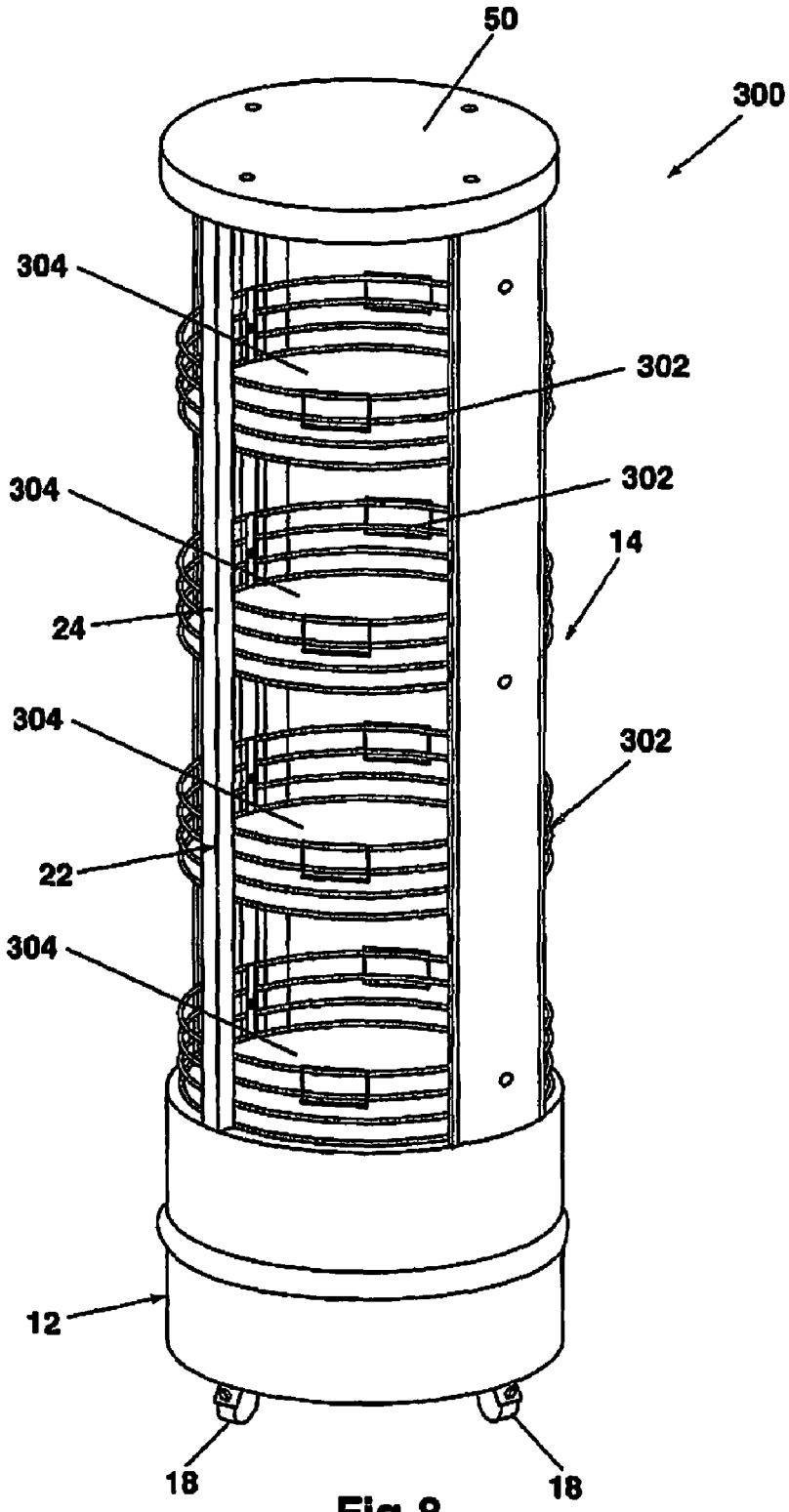
FIG. 8 is a perspective view of another point-of purchase display system according to the present teachings.
Figure 9:
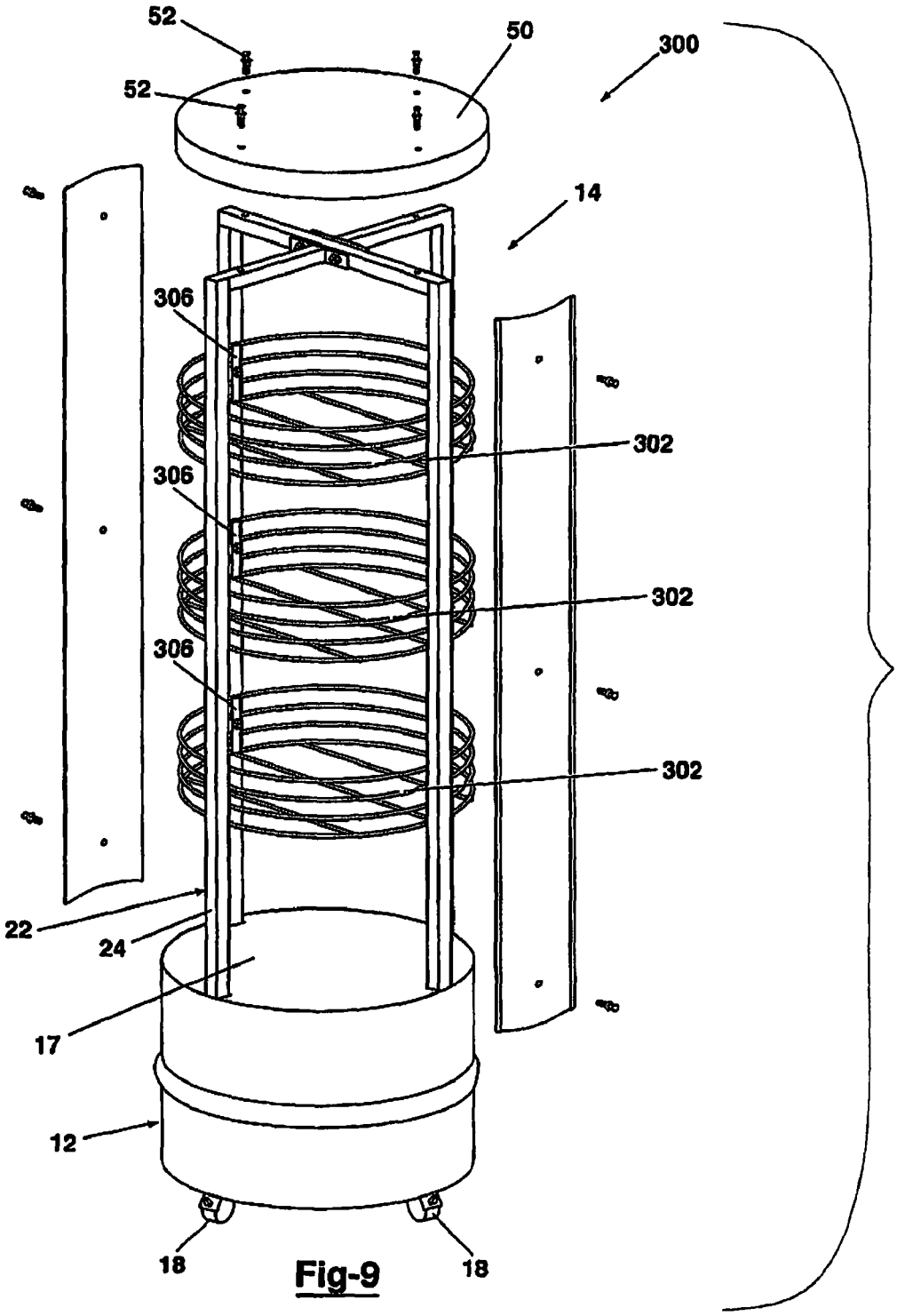
FIG. 9 is a partially exploded perspective view of the point-of-purchase display system of FIG. 8.

With reference to FIGS. 8 and 9, another point-of-purchase display system according to the present teachings is illustrated and generally identified at reference character 300. The display system 300 shares various features in common with the display systems 10 and 200 described above. Again, like reference characters have been used to identify substantially similar elements throughout the various drawings.

The display panels 38 of the display assemblies 10 and 200 may be eliminated in favor of a plurality of baskets 302. The plurality of baskets 302 may include four baskets. Alternatively, the display assembly 300 may include a greater or lesser number of baskets 302.

The baskets 302 may be of a wire construction. In this regard, the baskets 302 may include a wire formed bottom and a wire formed side. The wire formed bottom may support an insert 304 (see FIG. 8) for supporting product. The wire formed side may be generally cylindrical. The baskets 302 may be secured to frame 22. In this regard, the baskets 302 may be secured to the frame 22 with suitable brackets 306 or in any other manner well known in the art.

Figure 10:
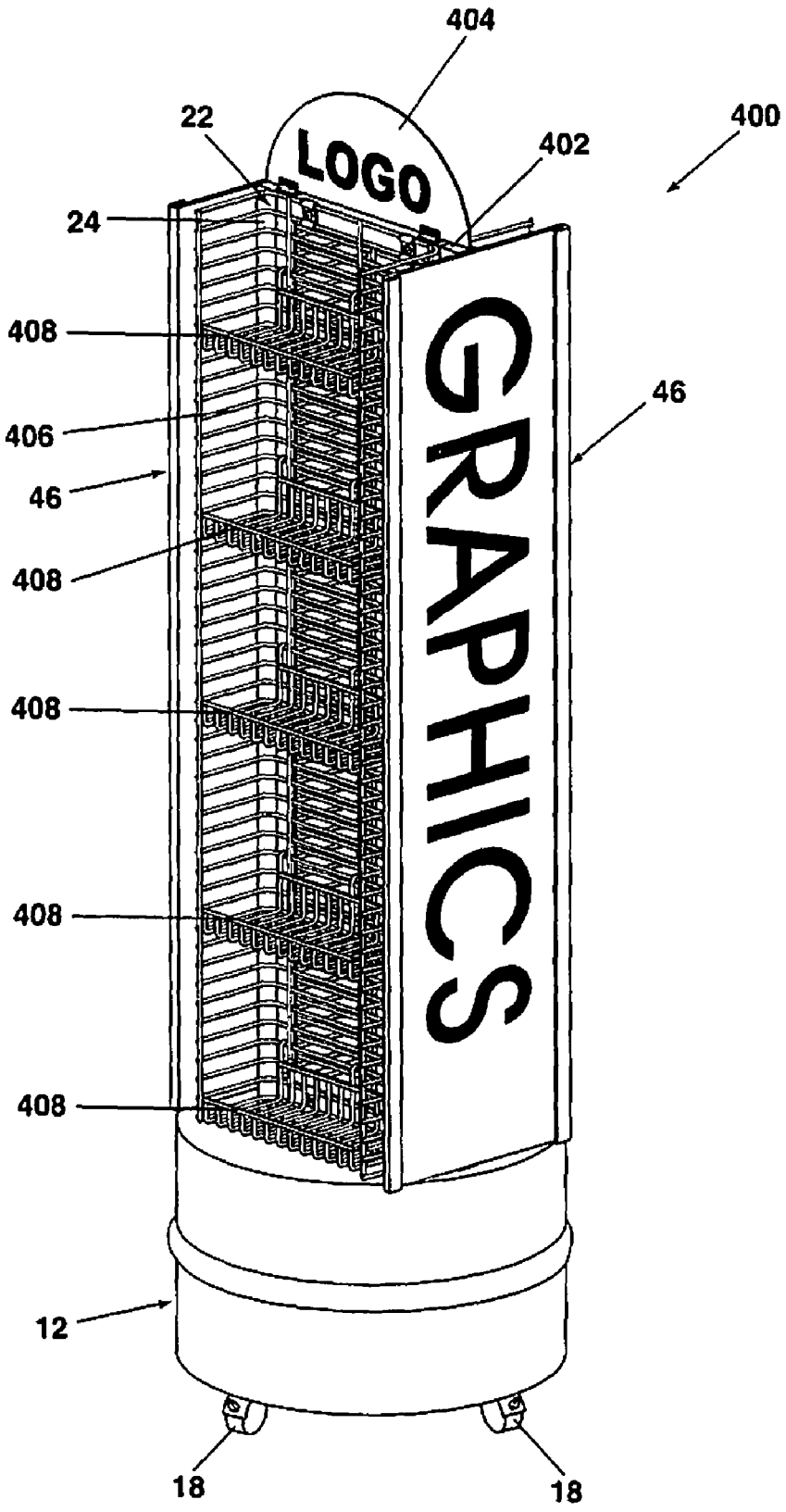
FIG. 10 is a perspective view of another point-of purchase display system according to the present teachings.

Turning to FIG. 10, another point-of-purchase display system according to the present teachings is illustrated and generally identified at reference character 400. The display system 400 shares various features in common with the display systems described above. Again, like reference characters have been used to identify substantially similar elements throughout the various drawings.

The display system 400 may differ from the display system 10 by including a frame 22 including a pair of upright members 24. The upright members 24 may be secured to one another at the top of the display assembly 400 to provide further structure. In this regard, the upright members 24 may be coupled to one another by a cross-connector 402. Advertising side panels 46 may be secured to the frame 22. A header card 404 may be secured to the cross-connector 402. Wire grids 406 and shelves 408 may be secured to opposing sides of the frame 22.

Figure 11:
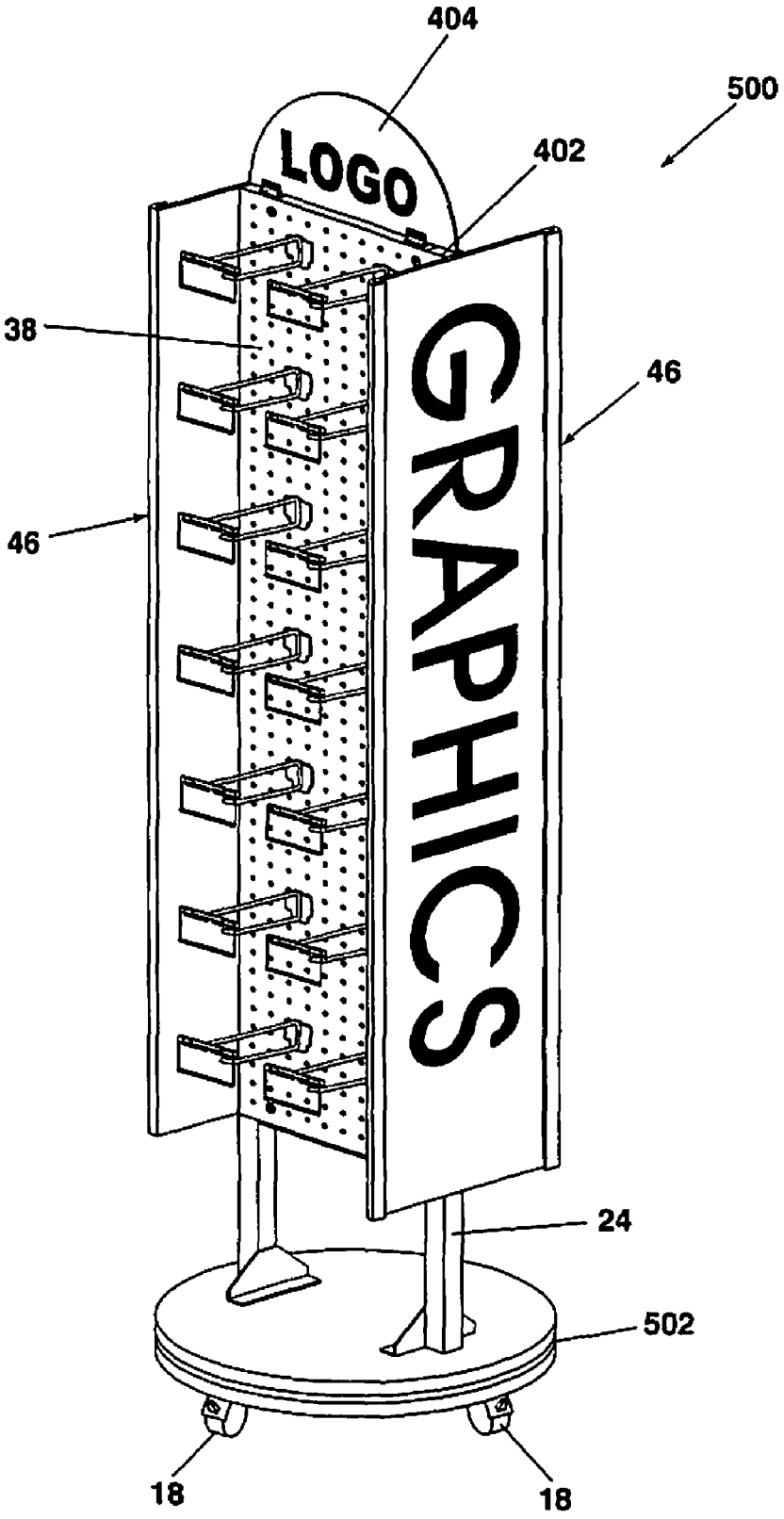
FIG. 11 is a perspective view of another point-of purchase display system according to the present teachings.

Turning to FIG. 11, another point-of-purchase display system according to the present teachings is illustrated and generally identified at reference character 500. The display system 500 shares various features in common with the display systems described above. Again, like reference characters have been used to identify substantially similar elements throughout the various drawings.

The display system 500 may again differ from the display system 10 by including a frame 22 including a pair of upright members 24. The upright members 24 may be secured to one another at the top of the display assembly 500 to provide further structure. In this regard, the upright members 24 may be coupled to one another by a cross-connector 402. Peg board panels 38 may be secured to opposing sides of the frame 22. Advertising side panels 46 may be secured to the frame 22. A header card 404 may be secured to the cross-connector 402. Conventional hooks may be suspended from the panels 38 for the suspension of product. The display system 500 may include a lower profile base 502.

Figure 12:
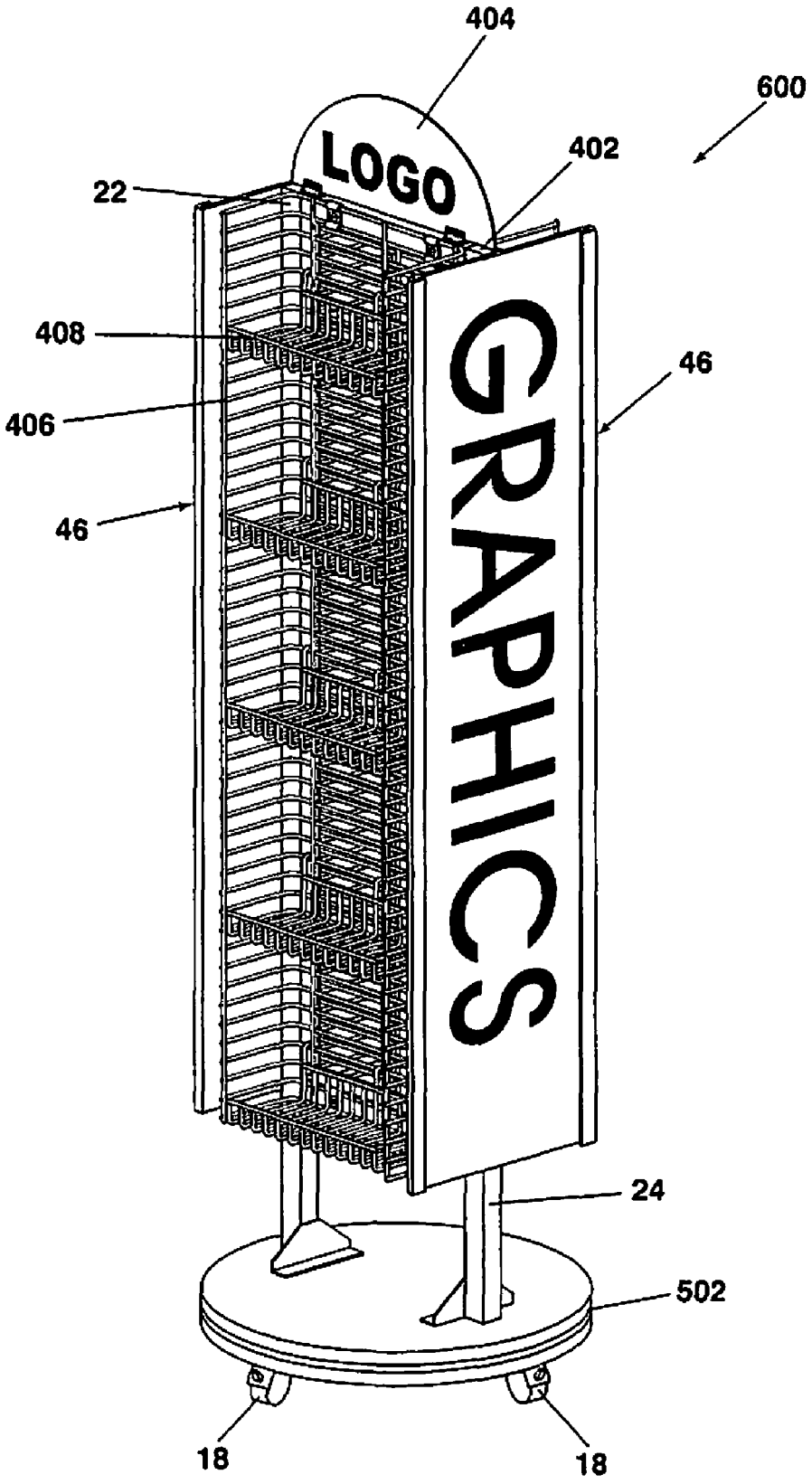
FIG. 12 is a perspective view of another point-of purchase display system according to the present teachings.

Turning to FIG. 12, another point-of-purchase display system according to the present teachings is illustrated and generally identified at reference character 600. The display system 600 shares various features in common with the display systems described above. Again, like reference characters have been used to identify substantially similar elements throughout the various drawings. The display system 600 may include a base 502 similar to the display system 500 and an upper portion similar to the display system 400.

Figure 13:
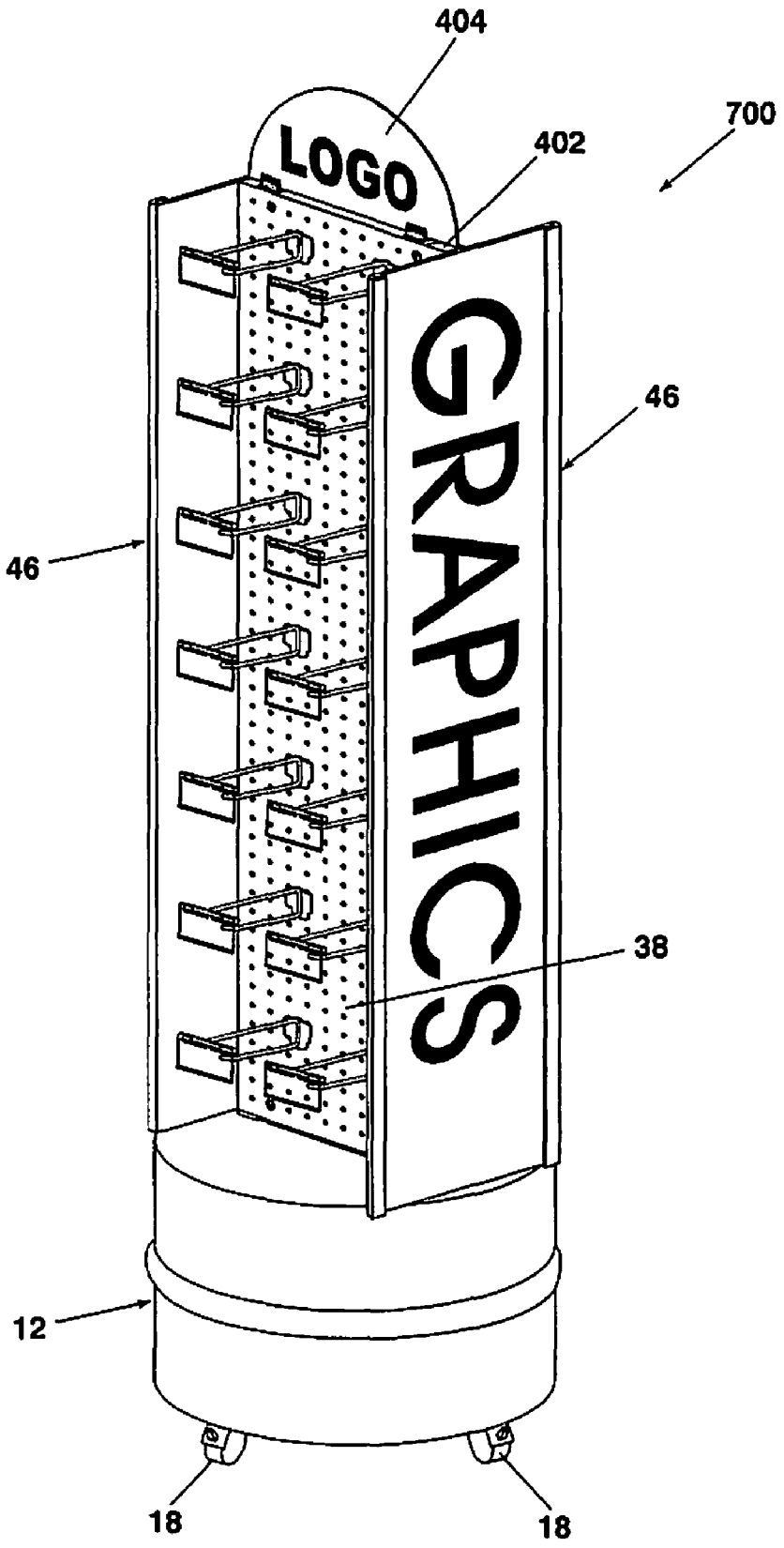
FIG. 13 is a perspective view of another point-of purchase display system according to the present teachings.

Turning to FIG. 13, another point-of-purchase display system according to the present teachings is illustrated and generally identified at reference character 700. The display system 700 shares various features in common with the display systems described above. Again, like reference characters have been used to identify substantially similar elements throughout the various drawings. The display system 700 may include a base 12 similar to the display system 10 and an upper portion similar to the display system 500.

While specific examples have been described in the specification and illustrated in the drawings, it will be understood by those skilled in the art that various changes may be made and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof. For example, the various embodiments may include acrylic dump bins or other mounting support accessories. Other embodiments may include a sign frame at the top having a top cap-sign for brand logo or price point call to action. Therefore, it may be intended that the present teachings not be limited to the particular examples illustrated by the drawings and described in the specification as the best mode of presently contemplated for carrying out the present teachings but that the scope of the present disclosure will include any embodiments following within the foregoing description and any appended claims.

What is claimed is:

1. A free-standing, point-of-purchase display comprising:

a generally cylindrical, self-supporting and hollow base portion having an outer surface having a curvature in a generally horizontal plane extending through the base portion;

a display portion upwardly extending from the base portion, the display portion including a frame having first and second tubular upright members and at least one planar display element for supporting product for retail display, the first and second upright members upwardly extending from the generally cylindrical base portion proximate opposite sides of the generally cylindrical base portion, the at least one planar display element secured to the first and second upright members, the first and second upright members bisecting the display in a vertical plane, the at least one planar display element having a width extending from the first upright member to the second upright member and a height which extends substantially along the entire lengths of the first and second upright members; and first and second advertising panels carried by the first and second upright members, respectively;

wherein the first and second advertising panels include a curvature in a generally horizontal plane extending through the advertising panels such that the curvature of the first and second advertising panels is substantially the same as the curvature of the outer surface of the generally cylindrical base portion.

2. The display of claim 1, further comprising third and fourth upright members extending from the generally cylindrical base portion, wherein the first, second, third and fourth upright members are equally spaced apart from one another about the outer perimeter of the base portion.

3. The display of claim 2, wherein the first, second, third and fourth upright members are fixed relative to one another proximate an upper end of the display.

4. The display of claim 1, wherein the advertising panels substantially extend along a height of the respective first and second upright members, and wherein the advertising panels each define a channel for slidably receiving a card with preprinted graphics.

5. The display of claim 1, further comprising a lower plate rotatably mounted to a bottom of the base portion such that the base portion, the first and second upright members and the at least one planar display element can rotate as a unit relative to the lower plate.

6. A merchandising display comprising:

a generally cylindrical and self-supporting hollow base having a base outer surface;

a generally cylindrical top having a top outer surface;

first and second upright members upwardly extending from the base to the top proximate diametrically opposed portions of the generally cylindrical base and the generally cylindrical top;

third and fourth upright members each upwardly extending from the base to the top, the first, second, third and fourth upright members being equally spaced apart from one another at four distinct radial positions about an outer perimeter of the base;

at least one planar display surface mounted to the first and second upright members, the at least one planar display surface defining a plane bisecting the generally cylindrical base and the generally cylindrical top, the at least one planar display surface vertically extending at least substantially along a length of the first and second upright members and horizontally extending across a diameter of the display, wherein the generally cylindrical top is orientated substantially parallel to the generally cylindrical base; and first and second advertising panels coupled to the first and second upright members, respectively, each advertising panel having a curvature in a horizontal plane extending through the advertising panels, the curvature being substantially the same as a curvature of the base outer surface.

7. The merchandising display of claim 6, wherein each of the advertising panels upwardly extends from the base to the top proximate the diametrically opposed portions of the generally cylindrical base and the generally cylindrical top.

8. The merchandising display of claim 6, further comprising a lower plate rotatably mounted to a bottom of the base such that the base, the top, and the first, second, third and fourth upright members and the at least one planar display surface can rotate as a unit relative to the lower plate.

9. The merchandising display of claim 6, wherein the first and second advertising panels each define a channel for slidably receiving a card with preprinted graphics.

10. A merchandising display comprising:

a generally cylindrical and hollow base having a base outer surface;

a generally cylindrical top having a top outer surface;

a display portion having first, second, third and fourth upwardly extending supports extending from the base to the top proximate an outer perimeter of the base, the first, second, third and fourth upwardly extending supports each having lower ends disposed inside the hollow base;

the display portion further comprising at least one planar display surface mounted to the first and second upwardly extending supports, the at least one planar display surface defining a plane bisecting the generally cylindrical base and the generally cylindrical top, the at least one planar display surface vertically extending at least substantially along a length of the first and second upwardly extending supports and horizontally extending across a diameter of the display, wherein the generally cylindrical top is orientated substantially parallel to the generally cylindrical base; and first and second advertising panels carried by the first and second upwardly extending supports, respectively, the advertising panels extending upwardly from the base substantially to the top, and proximate the outer perimeter of the base, each of the advertising panels having a curvature in a horizontal plane extending through the advertising panels, the curvature being substantially the same as a curvature of the base outer surface.

11. The merchandising display of claim 10, wherein the first, second, third and fourth upwardly extending supports are equally spaced apart from one another about the outer perimeter of the base.

12. The merchandising display of claim 10, wherein the first, second, third and fourth upwardly extending supports are fixed relative to one another proximate an upper end of the display.

13. The merchandising display of claim 10, wherein the at least one planar display surface comprises at least one display panel supported by the first and second upwardly extending supports.

14. The merchandising display of claim 10, wherein the advertising panels each define a channel for slidably receiving a card with preprinted graphics.

15. The merchandising display of claim 10, further comprising a lower plate rotatably mounted to a bottom of the base such that the base, the top, and the first, second, third and fourth upwardly extending supports and the at least one planar display surface can rotate as a unit relative to the lower plate.

* * * * *